US006957648B1

(12) United States Patent
Adcock

(10) Patent No.: US 6,957,648 B1
(45) Date of Patent: Oct. 25, 2005

(54) VIBRATION DAMPING ARCHERY BOW STAND

(76) Inventor: Matt Adcock, 232 Kentucky Derby Dr., Dublin, GA (US) 31021

( * ) Notice: Subject to any disclaimer, the term of this patent is extended or adjusted under 35 U.S.C. 154(b) by 53 days.

(21) Appl. No.: 10/720,283

(22) Filed: Nov. 25, 2003

(51) Int. Cl.[7] ..... F41B 5/00
(52) U.S. Cl. ..... 124/86; 124/89
(58) Field of Search ..... 124/23.1, 86, 88, 124/89; 248/188, 460

(56) References Cited

U.S. PATENT DOCUMENTS 1,645,421 A * 10/1927 Gloekler ..... 248/188
2,822,228 A * 2/1958 Comer ..... 248/188
2,904,379 A * 9/1959 Nelson ..... 403/297
3,256,872 A 6/1966 Koser
4,054,121 A * 10/1977 Hoyt, Jr. ..... 124/89
4,360,179 A 11/1982 Roberts
D314,303 S 2/1991 Glaspie
4,993,398 A 2/1991 Wallace
5,106,044 A 4/1992 Regard, III et al.
5,205,272 A * 4/1993 Boyer ..... 124/89
5,535,731 A * 7/1996 Webster ..... 124/89
5,547,162 A 8/1996 Sobolewski et al.
5,584,282 A * 12/1996 McDonald, Jr. ..... 124/89
5,630,407 A * 5/1997 Gasser ..... 124/89
D406,302 S 3/1999 Simpson et al.
6,205,992 B1 3/2001 Meeks et al.

* cited by examiner

*Primary Examiner*—John A. Ricci
(74) *Attorney, Agent, or Firm*—Dowell & Dowell, P.C.

(57) ABSTRACT

An adjustable and collapsible stand for archery bows which includes a pair of vertically adjustable legs carried by a bracket which is mounted to a bow and wherein vibration damping elements are mounted to each leg to thereby reduce vibrational energy created during use of the bow.

18 Claims, 3 Drawing Sheets

VIBRATION DAMPING ARCHERY BOW STAND

BACKGROUND OF THE INVENTION

1. Field of the Invention

This invention is generally directed to stands for use with hunting and target archery bows and more particularly to a bi-pod stand having a pair of detachable legs which include vibration damping elements to thereby reduce vibrational energy transmitted to the legs during use of the bows.

2. Brief Description of Related Art

A variety of stands have been developed for purposes of supporting archery bows not only to facilitate storage or display but also to provide stabilizing structures when bows are used for target use or hunting. In U.S. Pat. No. 3,256,872 to Koser, a stand and stabilizer for long bow type archery bows is disclosed which includes a bracket which is mountable to a portion of the riser or body of the bow and from which extend a pair of legs which form a bi-pod support structure. The legs are threadingly engaged with a block which is pivotally mounted to the bracket allowing the positioning of the legs. The stand is specifically designed for a long bow requiring that the bracket be attached to the body of the bow. When not in use, the legs are designed to be positioned adjacent to the body of the bow by pivoting the legs relative to the support bracket.

Stands have also been specifically designed for use with compound archery bows which generally include a stabilizer receiver or hole along the riser portions of the bows. U.S. Pat. No. 5,106,044 to Regard et al. discloses a portable compound bow stand having a bracket which is designed to be threadingly secured to the stabilizer receiver in the riser and which also includes a pair of legs forming a bi-pod stand. The legs are pivotal relative to the bracket to allow them to be positioned either at a forward support position or retracted against the lower portion of the bow when not in use.

A variation of support stand for compound type archery bows is disclosed in U.S. Pat. No. 4,360,179 to Roberts. The bow stand includes a single primary support leg which is treadingly received with the stabilizer receiver mounted or provided along the riser portion of the bow and a supporting bracket mounted at the bottom of the bow serving as a stabilizing surface.

At least a portion of each of the foregoing stands is specifically designed to remain fixed to the bow when not in use. Other examples of bow stands are disclosed in U.S. Pat. Nos. 6,205,992, 5,547,162 4,993,398, Des 314,303 and Des 406,302.

SUMMARY OF THE INVENTION

The present invention is directed to a stand for archery bows and particularly compound archery bows which have a stabilizer receiver or hole for selectively receiving a stabilizer device wherein the stand includes a bracket which is securable relative to the stabilizer receiver. The bracket includes a pair of spaced guide sleeves of a size to slidingly receive a pair of leg members therein such that the leg members are removable with respect to the guide sleeves. Securing means are provided in association with the guide sleeves to retain the leg members in position with respect to the bracket.

Each of the leg members includes a vibration damping member formed of a material which dampens vibrations along the length of the legs when the bow is fired. The stand functions as a bi-pod in cooperation with a lower cam or wheel of the compound bow to provide a stable support for the bow to maintain the bow in a vertical position. The legs may be easily removed and stored when not in use.

In preferred embodiments, the legs are formed of a carbon fiber material which may be solid or hollow in cross section. In some embodiments the vibration damping members are frictionally engaged about the legs whereas, in other embodiments, the vibration damping members are formed as plugs placed with the legs.

It is a primary object of this invention to provide a bow stand for use with different types of archery bows which can be easily mounted to a bow and wherein the legs may be removed from a mounting bracket associated with the bow stand.

It is yet a further object of the present invention to provide for vibration damping of the legs of a bow stand by providing vibration damping elements along each of the legs of a bi-pod stand such that vibrational energy directed along the legs is damped when a bow is fired.

BRIEF DESCRIPTION OF THE DRAWINGS

A better understanding of the invention will be had with respect to the accompanying drawings wherein.

DESCRIPTION OF THE PREFERRED EMBODIMENT

Figure 1:
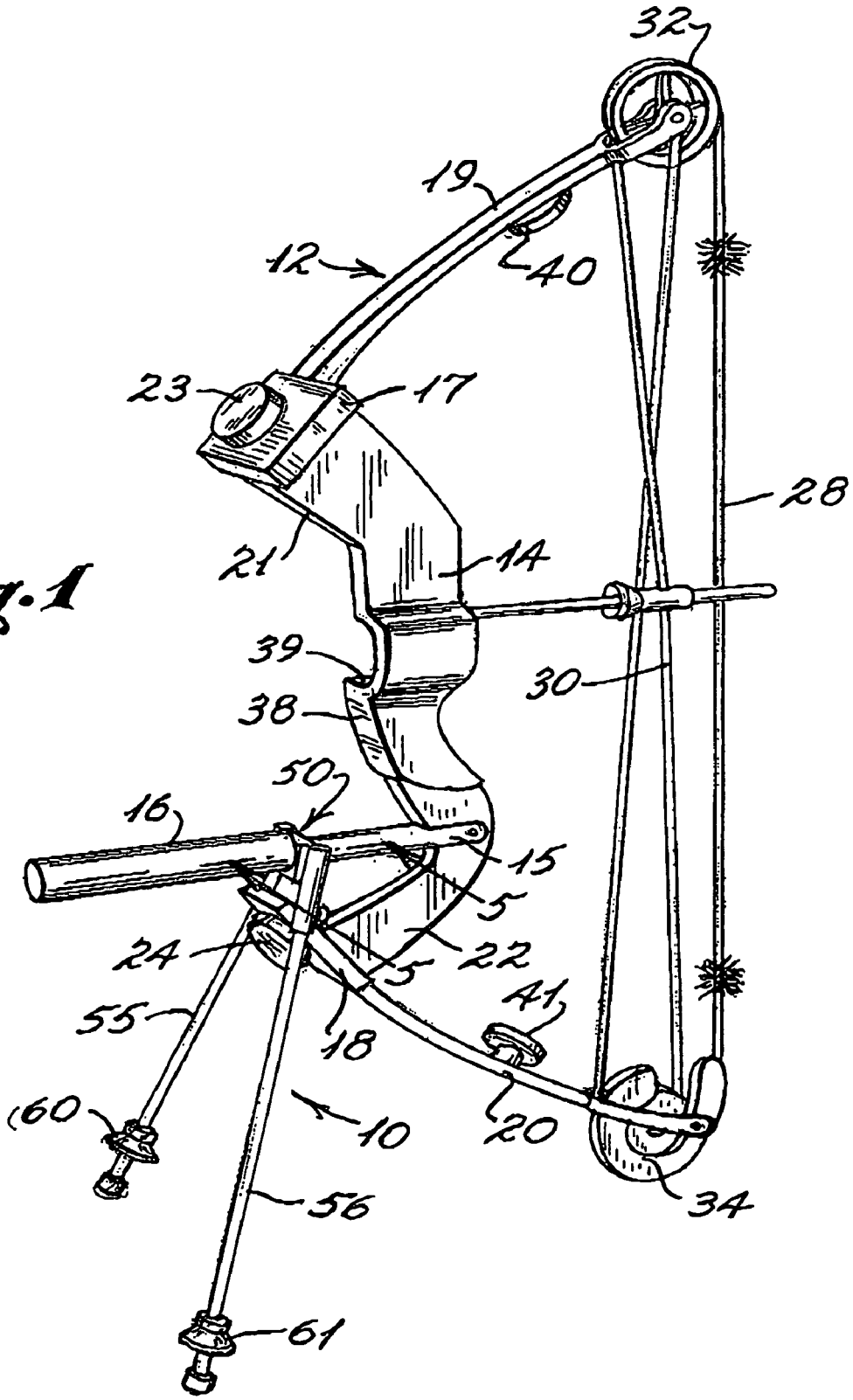
FIG. 1 is a front perspective illustrational view of the bow stand of the present invention mounted to a compound archery bow.
Figure 2:
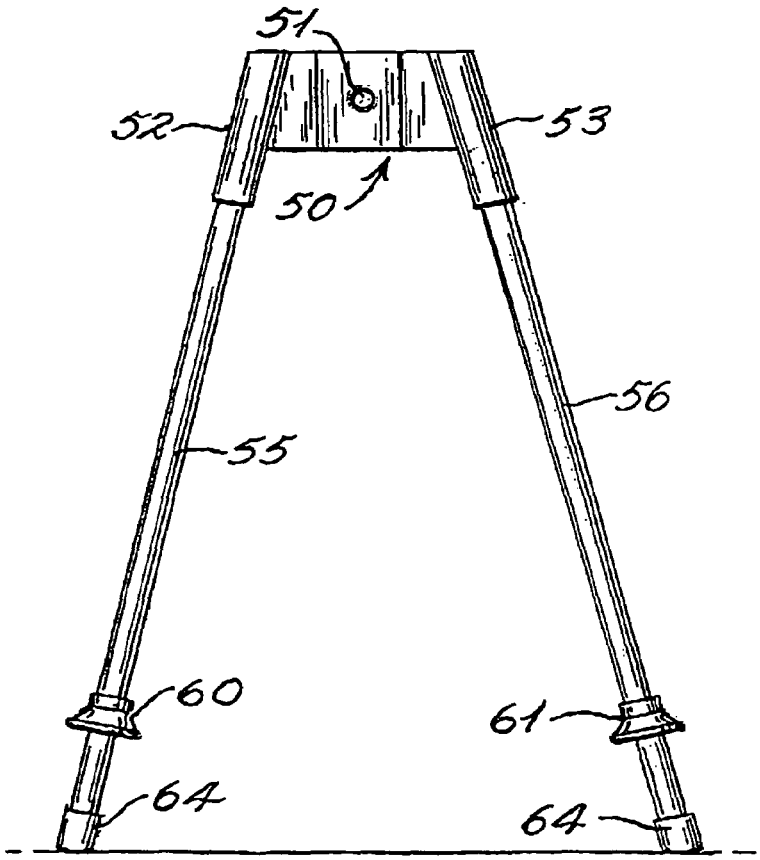
FIG. 2 is a front elevational view of the bow stand of FIG. 1.
Figure 3:
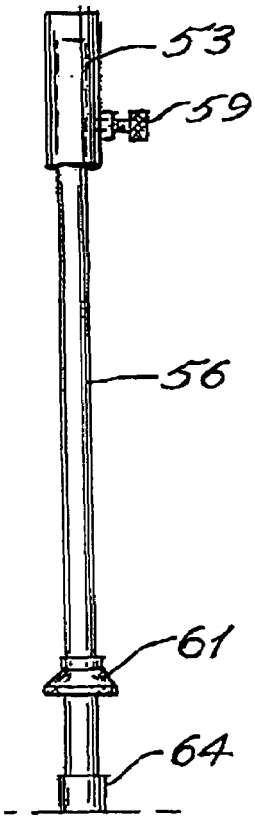
FIG. 3 is a left side view of the bow stand of FIG. 2.
Figure 4:
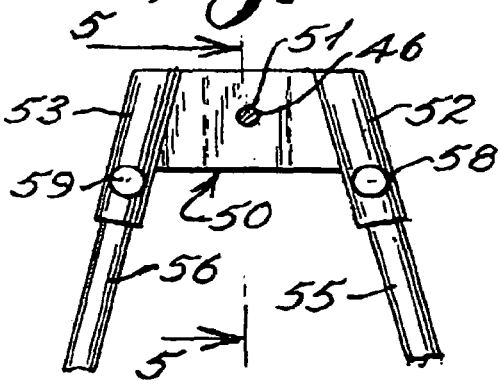
FIG. 4 is a partial rear elevational view of the bow stand of FIG. 2.
Figure 5:
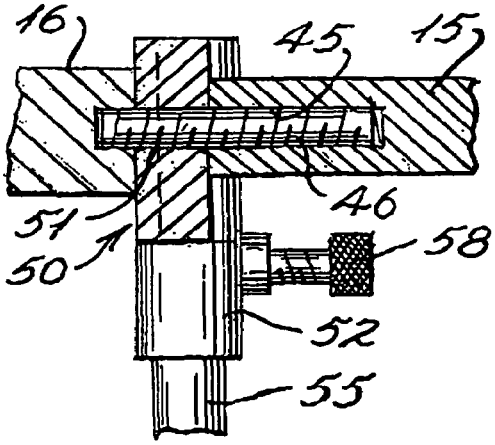
FIG. 5 is a partial cross sectional view taken along line 5—5 of FIG. 1.

With continued reference to the drawings, a bow stand 10 is shown as being secured to a riser 14 of a compound bow 12. Although the stand is shown as being particularly adapted for use with a compound bow having a conventional stabilizer mount 15 to which a stabilizer member 16 is selectively secured, the stand may be used with other bows having means for securing a stabilizer or other add-on devices associated therewith for purposes of securing the stand including recurve bows and long bows.

The compound bow shown in the drawing includes upper and lower mounting plates 17 and 18 which are used to secure upper and lower flexible limbs 19 and 20, respectively, to the upper and lower ends 21 and 22, respectively, of the bow riser 14. The limbs are secured using hand manipulatable threaded fasteners 23 and 24.

A bow string section 28 is operatively connected to a cable system 30 which extends about an upper pulley or cam wheel 32 and lower pulley or cam wheel 34. In compound bows, the cable system is used with upper and lower wheels or upper and lower cams. A cable guide 35 extends rearwardly of the bow riser 14.

The bow riser includes a hand grip 38 positioned below an arrow support notch or shelf 39. Vibration dampers 40 and 41 may be provided along the upper and lower flexible limbs as is shown in FIG. 1.

Most compound bows are provided with a threaded receiver along a lower portion of the riser for selectively permitting the mounting of a stabilizer. As previously noted, the bow shown includes a modified stabilizer mount 15 which extends forwardly of the riser and includes a threaded receiver 45 for receiving a threaded end 46 of the stabilizer 16. The stand 10 of the invention is specifically designed to be quickly and easily assembled and mounted to the bow 12 using the stabilizer 16 as a securing element, however, a separated securing element or fastener could be used. The stand includes an upper bracket 50 having an opening 51 for receiving the threaded end 46 of the stabilizer therethrough so that, as the stabilizer is secured to the stabilizer mount 15, the bracket is secured therebetween.

A pair of spaced guide sleeves 52 and 53 are provided on opposite sides of the bracket 50. The sleeves are open at their lower end and are of a size to cooperatively slidingly receive upper ends of legs 55 and 56. Adjustable locking bolts or set screws 58 and 59 are threadingly received within openings in the guide sleeves to thereby lock the legs in adjusted and assembled position relative to the bracket 50. When not in use, the legs may be quickly detached and stored in the archers quiver or other device to permit easy transport through wooded terrain or while traveling.

The legs 55 and 56 are preferably formed of carbon fiber or vibration damping materials, and, when assembled, form a bi-pod structure which functions with the lower cam 34 as a third leg for stability. The legs are designed to reduce vibration and, in a first embodiment, are provided with vibration dampers 60 and 61 which are formed of any suitable elastomeric material such as a rubber or synthetic rubber material. The dampers include central openings therethrough of a size which is complementary to the configuration of the legs such that the dampers extend around and are frictionally slidably mounted to the legs to thereby reduce undesirable vibrations which are generated along the legs when the bow is in use. The leg dampers provide an added benefit to the archer or hunter when using the bow 12. The lower end of each leg may include plastic or other type of cap 64.

The dampers 60 and 61 may vary in size, material and configuration. In this respect, in FIG. 9, the dampers are shown as elastomeric sleeves 65 which are frictionally engaged such as shown on leg 56 to thereby provide for vibration damping.

Figure 6:
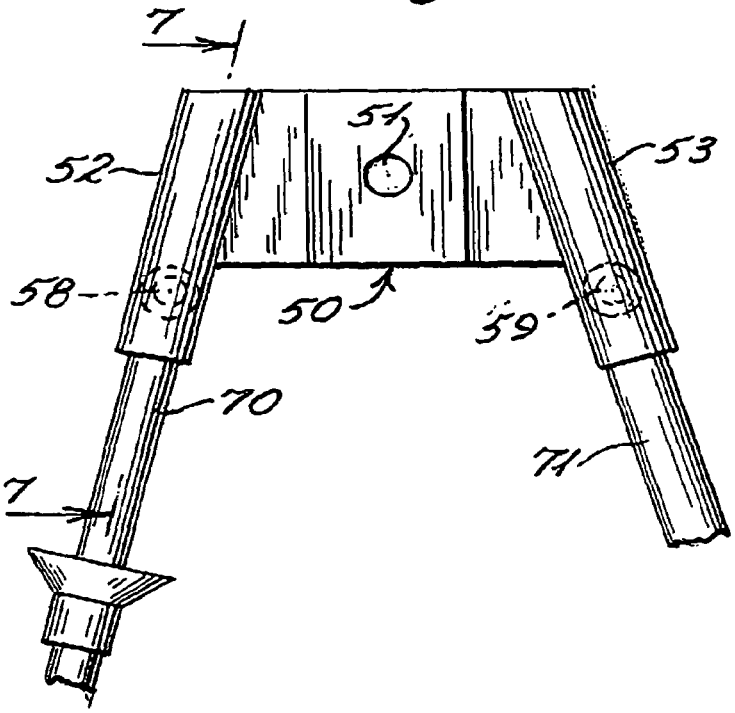
FIG. 6 is a partial rear elevational view of a varied embodiment of bow stand wherein the legs are hollow in cross section.
Figure 7:
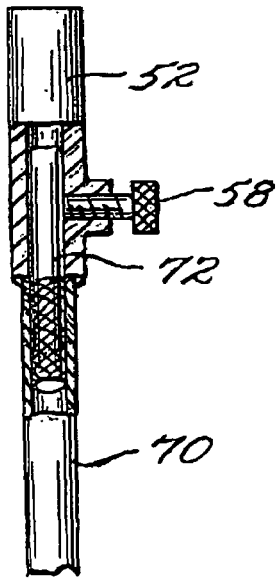
FIG. 7 is a cross sectional view taken along line 7—7 of FIG. 6.
Figure 8:
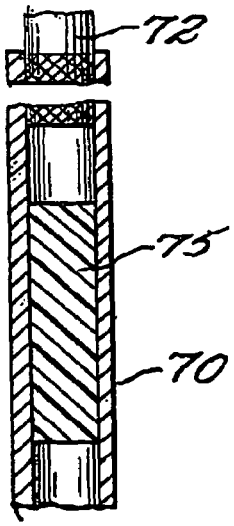
FIG. 8, is a partial cross sectional view taken through one of the legs of another embodiment of the invention showing an internal vibration damping plug.

The specific reference to FIGS. 6–8, a varied embodiment of the invention is disclosed in greater detail. In this embodiment, the stand includes the same bracket 50 including spaced guide sleeves 52 and 53 for mounting a pair of legs. In this embodiment, however, the legs 70 and 71 are formed as hollow tubes. The legs are removably mounted with respect to the sleeves 52 and 53 and are secured utilizing set screws 58 and 59 as previously described.

In the present embodiment, due to the hollow nature of each of the legs, a reinforcing metallic pin or plug 72 is mounted in the upper end of each of the legs and is adhesively secured within the upper portion of the tube. In this manner, set screws will not crush the upper hollow portion of the legs when tightened to secure the legs to the bracket 50.

Figure 9:
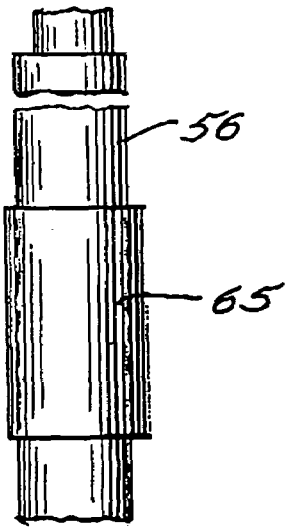
FIG. 9 is a partial view of one of the legs of a further embodiment of the invention showing the vibration damping member in a form of an external sleeve.

In the present embodiment, dampers such as disclosed at 60 and 61 in the previous embodiment may be used or dampers such as shown at 65 in FIG. 9 may be used. As an alternative, however, a damping plug 75, as shown in FIG. 8, may be inserted within each of the hollow legs in order to provide the necessary vibration damping. The same type of elastomeric material utilized with respect to the other embodiments of the invention may be used to form the plugs which are seated within either the upper or lower portion of the hollow legs. As with the previous embodiments, the damping members may be placed at substantially any place along the length of each of the legs depending upon the size and configuration of the damping members and the desired damping effect to be obtained.

With the present invention, the bracket may be left in mounted relationship between the stabilizer and the riser section of the bow with the legs being removed and stored for easy portability. With this arrangement, the bracket does not interfere with the normal use of the bow with the legs removed and therefore provides an additional benefit over conventional bow stands.

The foregoing description of the preferred embodiment of the invention has been presented to illustrate the principles of the invention and not to limit the invention to the particular embodiment illustrated. It is intended that the scope of the invention be defined by all of the embodiments encompassed within the following claims and their equivalents.

I claim:

1. A stand for vertically supporting an archery bow, the stand including; a bracket adapted to be removably mounted to the bow, a pair of leg members having upper portions mounted to said bracket so that said leg members are in spaced relationship to one another and oriented so as to extend vertically below a riser portion of the bow when said stand is mounted to the bow, said bracket including a pair of spaced guide sleeves of a size to slidingly receive one of said leg members therein, securing means associated with each of said guide sleeves for securing said leg members in adjusted positions within said guide sleeves, and a vibration damping member mounted to each of said leg members for dissipating vibrational energy transmitted along said leg members from the bow when the stand is mounted to the bow and the bow fired.

2. The stand of claim 1 wherein said vibration damping members are formed of an elastomeric material.

3. The stand of claim 2 wherein said vibration damping members are adjustably mounted to said leg members.

4. The stand of claim 2 wherein said vibration damping members have an opening therethrough of a configuration which is complimentary to a cross sectional dimension of said leg members whereby said vibration damping members frictionally engage said leg members.

5. The stand of claim 2 wherein said vibration damping members are formed as elastomeric sleeves frictionally mounted about said leg members.

6. The stand of claim 2 wherein each of said leg members is hollow, and said vibration damping members are formed as plugs inserted within said hollow leg members.

7. The stand of claim 6 wherein each of said hollow leg members includes a pin extending from an upper portion thereof for reinforcing the upper portion of said hollow leg members.

8. The stand of claim 1 wherein said vibration damping members are formed of an elastomeric material.

9. The stand of claim 8 wherein said vibration damping members are adjustably mounted to said leg members.

10. A combination archery bow and bow stand, comprising, an archery bow having a riser from which extend upper and lower limbs, a stand including a bracket adapted to be removably connected to said riser of said bow, said stand having a pair of leg members having upper portions mounted to said bracket so that said leg members are in spaced relationship to one another and extend outwardly and vertically downwardly relative to said riser so that said leg members and said lower limb support said bow vertically on a surface, said bracket includes a pair of spaced guide sleeves of a size to slidingly receive one of said leg members therein, and securing means associated with each of said guide sleeves for securing said leg members in adjusted positions within said guide sleeves, and a vibration or damping member mounted to each of said leg members for dissipating vibrational energy transmitted from said bow when said stand is mounted to said bow and said bow fired.

11. The combination archery bow and bow stand of claim 10 wherein said vibration damping members are formed of an elastomeric material.

12. The combination archery bow and bow stand of claim 11 wherein said vibration damping members are adjustably mounted to said leg members.

13. The combination archery bow and bow stand of claim 11 wherein said vibration damping members have an opening therethrough of a configuration which is complimentary to the cross sectional dimension of said leg members whereby said vibration damping members frictionally engage said leg members.

14. The combination archery bow and bow stand of claim 11 wherein said vibration damping members are formed as sleeves frictionally mounted about said leg members.

15. The combination archery bow and bow stand of claim 11 wherein each of said leg members is hollow, and said vibration damping members are formed as plugs inserted within said hollow leg members.

16. The combination archery bow and bow stand of claim 15 wherein each of said hollow leg members includes a pin extending from said upper portion thereof for reinforcing said upper portion of said hollow leg members.

17. The combination archery bow and bow stand of claim 10 wherein said vibration damping members are formed of an elastomeric material.

18. The combination archery bow and bow stand of claim 17 wherein said vibration damping members are adjustably mounted to said leg members.

* * * * *